United States Patent [19]

Hartmann

[11] Patent Number: 4,997,611

[45] Date of Patent: Mar. 5, 1991

[54] PROCESS FOR THE PRODUCTION OF NONWOVEN WEBS INCLUDING A DRAWING STEP AND A SEPARATE BLOWING STEP

[75] Inventor: Ludwig Hartmann, Weinheim, Fed. Rep. of Germany

[73] Assignee: Carl Freudenberg, Weinheim/Bergstr, Fed. Rep. of Germany

[21] Appl. No.: 200,239

[22] Filed: May 31, 1988

[30] Foreign Application Priority Data

Aug. 22, 1987 [DE] Fed. Rep. of Germany ..... 3728002

[51] Int. Cl.[5] ..... B29C 47/14; B29C 47/16; D01D 5/12

[52] U.S. Cl. ..... 264/210.8; 156/167; 156/181; 156/441; 264/237; 425/66; 425/72.2

[58] Field of Search ..... 156/167, 181, 441; 264/210.8, 103, 518, DIG. 28, DIG. 73, 177.19, 237; 425/72.2, 66, 83.1

[56] References Cited

U.S. PATENT DOCUMENTS

| | | | |
|---|---|---|---|
| 2,398,831 | 4/1946 | Hoffmann | 156/167 |
| 3,304,220 | 2/1967 | McIntyre | 156/167 |
| 3,436,797 | 4/1969 | Graf et al. | 156/167 |
| 3,441,468 | 4/1969 | Siggel et al. | 156/167 |
| 3,511,747 | 5/1970 | Davies | 156/181 |
| 3,565,729 | 2/1971 | Hartmann | 156/167 |
| 3,639,195 | 2/1972 | Sanders | 156/181 |
| 3,737,508 | 6/1973 | Weir | 264/204 |
| 3,802,817 | 4/1974 | Matsuki et al. | 425/66 |
| 3,902,833 | 9/1975 | Matovinovic | 425/66 |
| 3,929,542 | 12/1975 | Gehrig et al. | 264/210.8 X |
| 3,991,250 | 11/1976 | Hartmann et al. | 156/167 |
| 4,089,720 | 5/1978 | Haley | 156/167 X |
| 4,340,563 | 7/1982 | Appel et al. | 425/72.2 X |
| 4,578,134 | 3/1986 | Hartmann | 156/167 |
| 4,627,811 | 12/1986 | Greiser et al. | 425/72.2 |
| 4,838,774 | 6/1989 | Balk | 425/66 |

FOREIGN PATENT DOCUMENTS

| | | | |
|---|---|---|---|
| 845078 | 6/1970 | Canada | 156/167 |
| 1660318 | 3/1970 | Fed. Rep. of Germany . | |
| 1950435 | 4/1971 | Fed. Rep. of Germany . | |
| 2137342 | 2/1972 | Fed. Rep. of Germany . | |
| 3603814 | 8/1987 | Fed. Rep. of Germany . | |
| 1215537 | 12/1970 | United Kingdom | 156/167 |

*Primary Examiner*—Michael W. Ball
*Assistant Examiner*—Steven D. Maki
*Attorney, Agent, or Firm*—Keil & Weinkauf

[57] ABSTRACT

For the production of spunbonded fabrics there is given a process consisting in that monocomponent or bicomponent fibers are spun from multiline longitudinal spinning nozzles mounted in rows on double spinning beams in such a way that the emerging filament rows overlap over the entire production width, that, before depositing, the filament rows are cooled by transverse blowing from one side and by sucking-off on their other side freed from spinning vapors, mechanically and/or aerodynamically stretched and deposited to the web.

The apparatus described comprises double spinning beams with a length of 800 to 8,000 mm which carry multiline longitudinal spinning nozzles staggered to one another with high hole numbers, with lengths of the individual nozzles from 500 to 700 mm.

10 Claims, 4 Drawing Sheets

Figure 1:
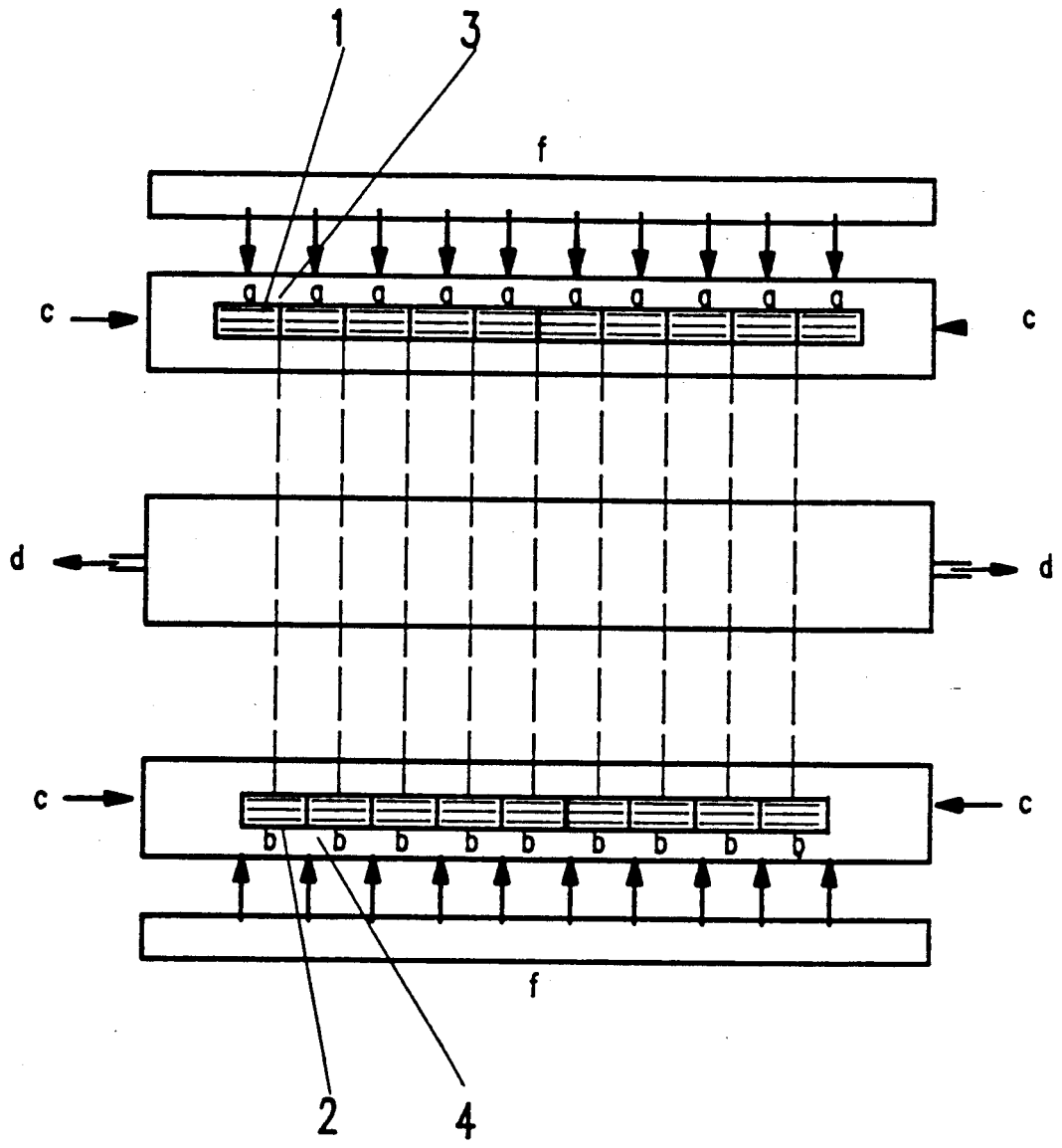

PROCESS FOR THE PRODUCTION OF NONWOVEN WEBS INCLUDING A DRAWING STEP AND A SEPARATE BLOWING STEP

The present invention relates to a process for the production of monocomponent or bicomponent fiber spunbonded fabrics by spinning one or several filament-forming polymers from longitudinal spinning nozzles.

The production of fabric materials by spinning filament-forming polymers requires large-scale technical installations which are capable of spinning as many filaments as possible and depositing them into a fabric in as confined a space as possible, especially when different polymers are to be processed simultaneously in the most confined space. Here, working widths of over 5 m are often necessary for large-surface spunbonded fabrics, in which a large number of filaments must be deposited in great widths in such a way that there is achieved the highest possible uniformity of the surface deposition.

Fabric materials of different fiber polymers offer the possibility of achieving specific product properties; thus, by a combination of polyester as structure fibers and copolyester (with low softening point), polyamide or polypropylene as bonding fibers it is possible to produce high-strength web materials in widths of over 5 m, which are excellent)suited as tufting carriers. There, structure and bonding fibers are spun from separate spinning nozzles and deposited together into a mixed fabric. Further, with a combination of polypropylene and polyethylene (bonding component) there arise specially soft fabric materials. Especially voluminous spunbonded fabrics result when the components are spun in a side-by-side arrangement as heterofilaments from one spinning nozzle each with one-sided blowing with air and brought into crimping by reason of differing tension relations. Such spunbonded fabrics are especially suited for hygienic use.

Other spunbonded fabrics may consist of heterofilaments which are likewise spun from a spinning nozzle, but in core/mantle arrangement, in which the polymer component with higher melting point is the core.

The hitherto known spunbonded fabric processes yield either a high throughput, but a poor web pattern, or a very good and uniform fiber deposition, but only a low working velocity.

Neither processes nor installations are known which with sufficiently small construction space permit spinning at will either monofile, multifile or heterofile fibers in such a way that compact as well as voluminous fabric materials can be produced in webs of up to more than 5 m in width, without losses in respect to the surface uniformity, the overlapping and thorough mixing (in the case of separate structure and bonding fibers) and, accordingly, of the dimensional stability of the product when the operating velocity and the polymer throughput are set economically high.

The task of the present invention lies in giving a process and an apparatus for the production of spunbonded fabrics, with which the dilemma mentioned between product quality and production speed is overcome. In this connection the following demands in particular are to be brought into harmony:

Realizing many spunbonded fabric variants on one installation in large product widths with only a small space requirement;

Spinning as large as possible a number of filaments, optionally also from different polymers, either as separate fibers in high comingling or as bicomponent fibers in high surface uniformity in the deposition for the achievement of a good drawing and strength behavior of the fabric in longitudinal and transverse direction, in order to withstand high processing velocities without harm;

Spinning with high polymer throughput, in order to be able to maintain high machine velocities also in the possibly ensuing further treatment processes;

High overlapping and surface uniformity at will of the individual fiber layers in the deposition (for the production of absorbent layers with worked-in superabsorber powder).

The solution of the problem consists in a process with the characterizing features of claim 1 and in an apparatus with the characterizing features of claim 12. The subclaims allocated in each case relate to preferred process or further development variants and will be explained still in the following.

The present invention describes a so-called compact spinning process and an apparatus suited for it, which, on the one hand, make it possible to spin a large number of filaments in the most confined space and, on the other hand, open up the possibility, without complicated modifications in technical installations, of spinning at will both monocomponent and bicomponent filaments or mixtures of filaments and of depositing them in good thorough mixture into a uniform fabric. This advantage of simple variations permits, in a preferred process mode, making a mixed fabric of two different polymer components, as the one polymer component is spun on one of the double spinning beams and on the other the second polymer component, the different polymer filament rows forming from the two nozzle rows are cooled and gathered to a common filament roving extending over the working width, led into a common drawing-off channel and then deposited in common into a mixed fabric.

Another advantageous variant is suited for the production of bicomponent fabrics in core/mantle or side-by-side structure and is characterized in that the two different polymers are introduced in two spinning nozzle rows which comprise nozzles in mantle/core or side-by-side arrangement, that the component filament rows forming from the nozzle rows are brought together and deposited over the entire fabric processing width in a broad filament-strip band.

The one polymer constituent of a polymer component pair serves mostly for the fiber bonding in the fabric material structure and, therefore, is chosen with lower melting point than the second component, determining the fiber structure.

Here, bonding components of, for example, polyethylene can be combined with in each case higher melting polymers, such as polypropylene, polyethylene terephthalate, as well as polyamide. The corresponding components must be selected according to the field of use of the spunbonded fabrics made from them; thus, for example, in the production of tufting carriers or materials for bituminous lamination polyesters are taken as structure fiber, while for hygienic products polyolefins are generally used, although here, too, combinations of polyester and polyolefin as bicomponent fiber are thinkable, because in this case higher volumes of the fabrics can be achieved in crimping processes.

The selection of the polymer component pairs depends, therefore, on the particular purpose of use of the fiber fabric material to be produced, and preferred pairings are:

Polyester and copolyester, polyester and polypropylene, polyester and polyethylene, as well as polyester and polyamide.

Further polymer pairs can be polypropylene or polyethylene types with different molecular weight distribution and different melt flow indices.

Further possible are polymer combinations that differ through dissimilar additive substances, such as, for example, through high-polymer softeners, dyes and/or optical brighteners.

The 800 to 8,000 mm long double spinning beam of the invention with several rows of staggered longitudinal spinning nozzles has the great advantage of making it possible, in a compact manner of construction, to arrange a very large number of spinning nozzles, which through mutual staggering yield a continuous, broad filament row after the thread gathering. Hereby there can be achieved working widths of 6 m and above. The fact that the specific spinning beam is fitted with individual nozzles has the advantage that in case of disturbances individual nozzles can be quickly taken out and exchanged, which would be difficult and time-consuming with nozzles that covered the entire working width. With the nozzles of the invention, changes are possible within 20 to 30 minutes. The nozzle lengths amount according to the invention to from 500 to 700 mm with spinning hole row lengths of 450 to 600 mm, i.e., through the staggered construction, spacings of 40+40=80 mm must be covered by the oppositely lying hole rows.

With the so-called compact spinning process according to the invention one works with hole numbers of over 1,000 to over 10,000 per nozzle—depending on the denier of the spunbound fabrics to be produced or their individual filaments. Through the arrangement of the spinning nozzles in straight rows with the allocated blowing shaft and the sucking-off device, which extend in each case over the entire installation width, such high numbers of holes are possible because a rapid cooling of the filaments or filament row is assured, and, therefore, a rapid loss of stickiness.

Up to 30,000 and more filaments per spinning nozzle, therefore, can be spun, cooled and deposited into a spunbonded fabric. With working widths of 6 m on the compact spinning apparatus accordingly, 600,000 and more filaments can be deposited in the most confined space into a very dense, uniform web.

A preferred embodiment of the apparatus according to the invention for the convenient drawing of thread rows consists that between the lower edge of the spinning nozzles and the upper edge of the sucking-off and thread guide channel there are arranged deflecting rollers and/or drawing mechanism pairs.

Another execution, preferred for the especially uniform charging with filament rows over the entire working width, has longitudinal spinning nozzles which carry linear hole rows with hole numbers differing from the middle to the border zones.

A more thorough discussion of the invention, as well as its further achievable advantages, is given in the following with the aid of FIGS. 1 to 4.

Figure 2:
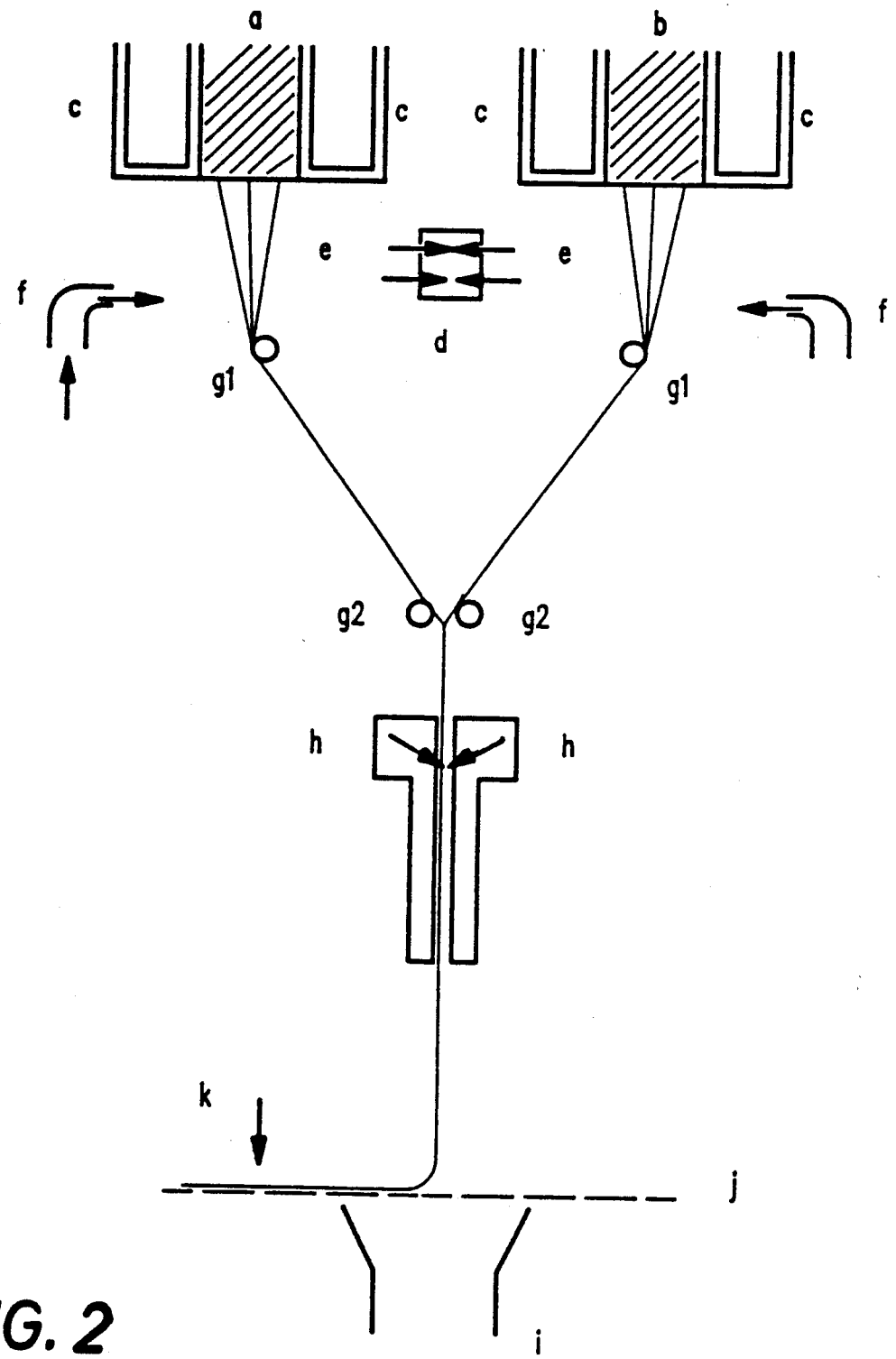
Figure 3:
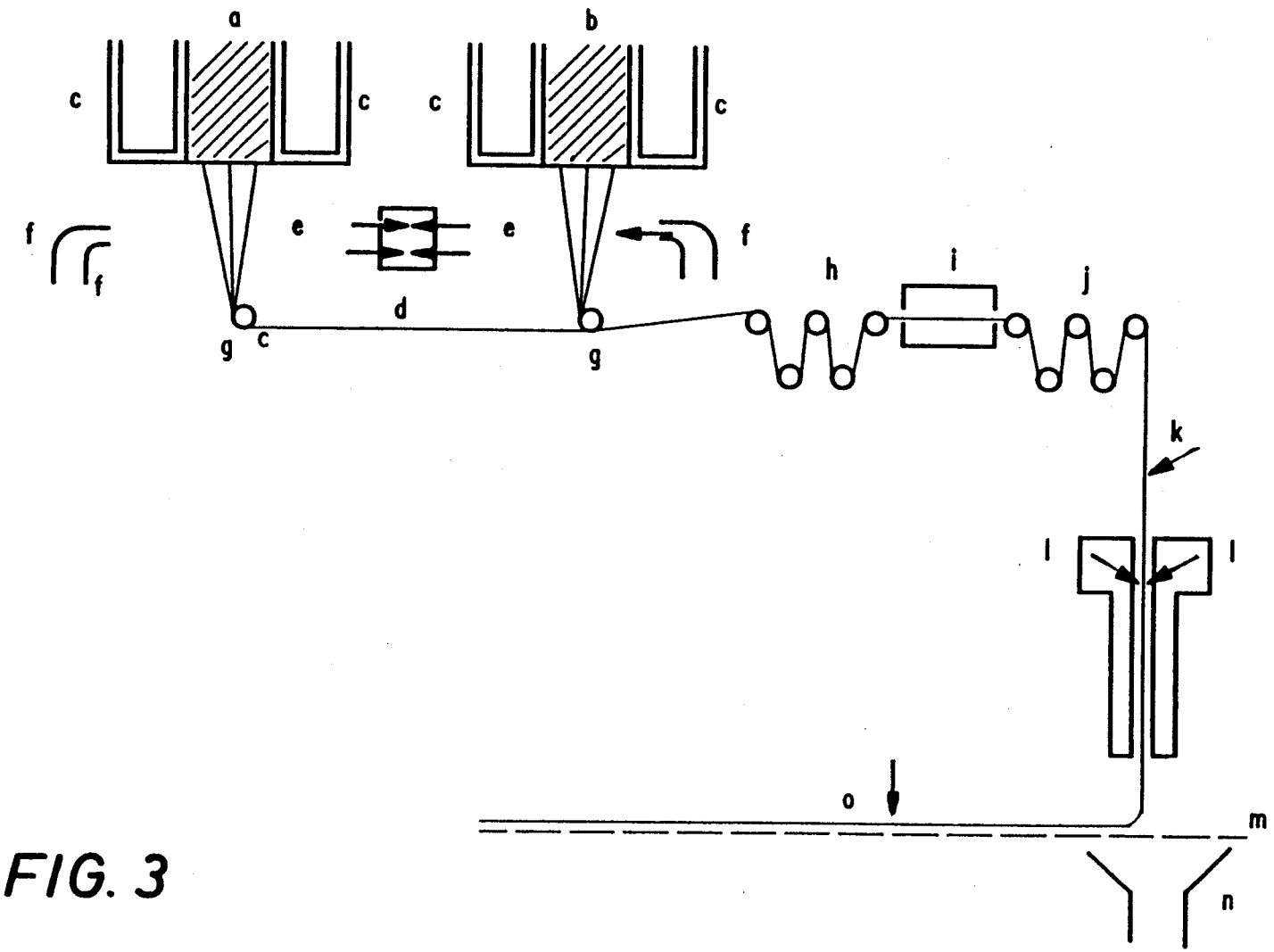

FIG. 1 shows a form of execution of the compact spinning apparatus of the invention in plan;

FIG. 2 a vertical section through the schematically represented structure of the compact spinning apparatus;

FIG. 3 a variant apparatus with interposed drawing mechanism and

Figure 4:
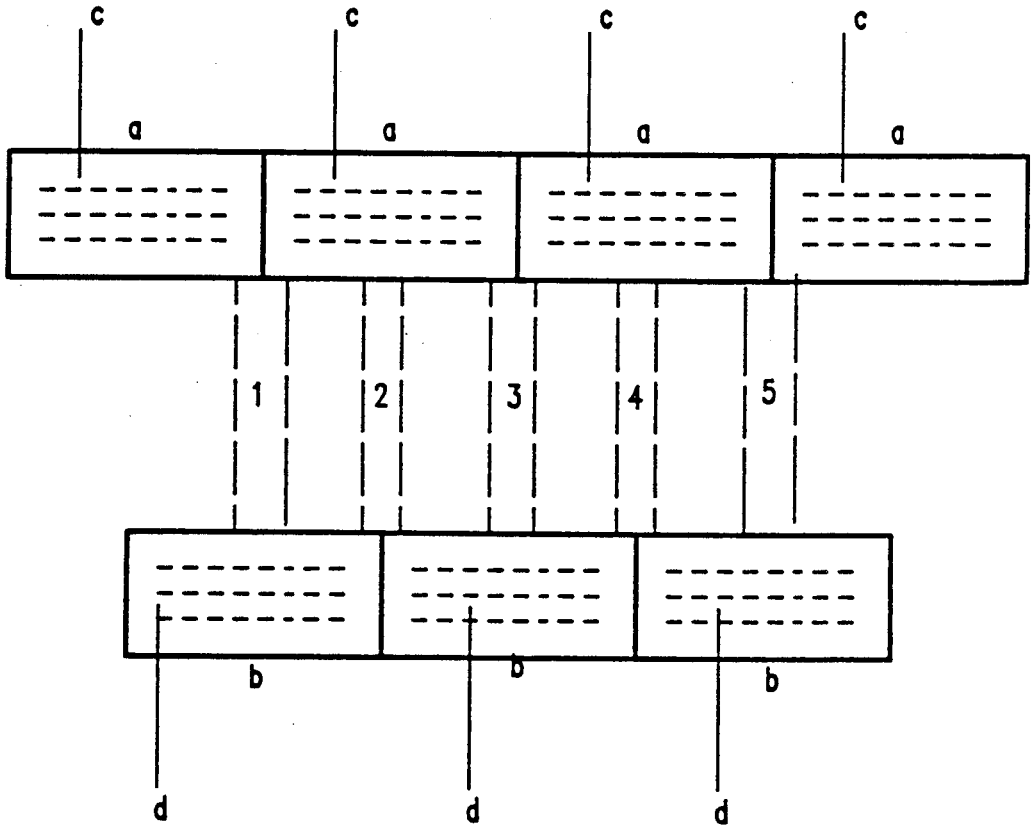

FIG. 4 shows in plan the arrangement of the spinning nozzles and their hole rows.

First of all, let FIG. 1 be viewed In the spinning beam arrangement with c there is designated the double spinning beam on which the spinning nozzles a and b are arranged. From the spinning nozzles a there can be spun in each case a polymer different from that spun from those designated with b—therefore, for example, from a polypropylene and from b polyethylene. By selection of corresponding nozzles and the appertaining formation of the melt feed, both from a and from b bicomponent filaments can be spun in the mantle/core or side-by-side execution.

As is evident from FIG. 1, an essential feature of the spinning beam is that the spinning hole rows 1 and 2 of the individual nozzles a and b are staggered to one another in such a way that the gaps 3 and 4 are overlapped in each case by the oppositely lying spinning hole row It is thereby achieved that the thread rows that emerge from the spinning hole rows are drawn downward and, as represented in FIG. 2 still to be discussed, are collected at g2, and yield a cohesive band of filaments over the entire width of the installation.

On the outsides of the spinning beam there is arranged in each case a blowing shaft with nozzles f, which cools the filament rows, and on the inside of the spinning beam there is present a sucking-off device d which eliminates the blowing air passing through the filament rows as well as the spinning vapors. The one-sided blowing in the production of crimpable filaments has the advantage of increasing their internal tensions, so that in a later expansion step a crimping can be achieved.

FIG. 2 shows schematically in section a compact spinning apparatus with the two spinning beams c, which carry the nozzle rows a and b. On both sides of the filament rows there are present the blowing nozzles f for cooling the filament rows, and in the middle the sucking-off device d, which at e receives the spinning vapors. The deflecting rollers g1 and g2 serve for the further conduction of the filament rows, which are introduced into the aerodynamic drawing-off channel h and with the aid of the air currents supplied through longitudinal slits drawn downward, stretched and fed to the collecting band j. Under the perforated collecting band there is arranged the sucking-off device i, which, after the fabric formation, takes up the excess air, while the formed fabric k is supplied to the further processing i.e. to the "consolidation", by which is meant bonding after deposition in a separate further step .

At point g2 the filaments already have a temperature at which they are no longer sticky. In impingement zone k, in the fabric formation, they are cooled to room temperature.

FIG. 3 shows an embodiment in which between spinning apparatus and fabric formation there was additionally interposed a mechanical drawing. With the aid of the deflecting rollers g the thread rows are mechanically stretched in the drawing mechanisms h and j.

A heating channel i is interposed to heat up the filament rows. After the stretching here, too, they are introduced into an aerodynamic shaft 1, which feeds them to the collecting band m with underlying sucking-off n, whereby there arises the fabric O. This is then fed to the consolidation installation.

FIG. 4 shows in plan, again in a cut-out, the arrangement of the spinning nozzles a and b with the hole rows c and d and with overlapping zones 1 to 5. In the production of mixed fabrics different polymers in each case are spun from the spinning nozzle rows a and b. In order to obtain a uniform charging with filaments over the entire working width, in the overlapping zones 1 to 5 and in the interlying regions in which filaments are obtained from both oppositely lying spinning nozzles, the spinning nozzles are arranged in such a way that a uniform filament row arises over the entire working width. That is, in the zone in which the spinning nozzles no longer carry any spinning hole rows (border zones of the nozzles) the oppositely lying spinning nozzles b contain correspondingly more holes.

What is claimed is:

1. A process for the production of nonwoven webs from one or a plurality of filament forming polymers, comprising the steps of providing a first spinning beam, providing a second spinning beam parallel to the first spinning beam, providing the first spinning beam and the second spinning beam with a plurality of nozzles wherein the nozzles have straight rows of holes and the straight rows of holes of one particular nozzle on the first spinning beam are in staggered and overlapping relation with the straight rows of holes of another nozzle on the second spinning beam, spinning out of the nozzles on the first and second spinning beams two respective filament rows, said spinning step entailing the incidental production of spinning vapors, drawing said filament rows, and laying said filament rows down to form a web, wherein said process further comprises providing outlet means and inlet means, one of said means being disposed on the outside of each said filament row and the other of said means being disposed at a location intermediate said two spinning beams as viewed in vertical projection, and also comprises, prior to said drawing step, the separate step of blowing said filament rows perpendicularly thereto from said outlet means to cool said filament rows, and sucking off the spinning vapors into said inlet means.

2. A process according to claim 1, which comprises spinning one of two polymer components from the nozzles of the first spinning beam and the other polymer component from the nozzles of the second spinning beam, and laying both components down together to form a mixed web.

3. A process according to claim 1, which comprises spinning two filament forming polymers from the nozzles of the first and second spinning beams as bi-component mantle/core or side-by-side filaments.

4. A process according to claim 2 or 3, wherein as polymer pair there are used polypropylene and polyethylene.

5. A process according to claim 2 or 3, wherein as polymer pair there are used polyester and copolyester.

6. A process according to claim 2 or 3, wherein as polymer pair there are used polyester and polypropylene.

7. A process according to claim 2 or 3, wherein as polymer pair there are used polyester and polyethylene.

8. A process according to claim 2 or 3, wherein as polymer pair there are used polyester and polyamide.

9. A process according to claim 2 or 3, wherein as polymer pair there are used polypropylene types with different molecular weight distribution and different melt flow indices.

10. A process according to claim 2 or 3, wherein as polymer pair there are used polyethylene types with different molecular weight distribution and different melt flow indices.

* * * * *